United States Patent [19]

Zahlaus

[11] Patent Number: 4,702,097

[45] Date of Patent: Oct. 27, 1987

[54] PROCESS FOR THE BENDING OF ROD-LIKE MATERIALS

[76] Inventor: Helmut Zahlaus, Königsberger Strasse 27, D-6239 Kriftel, Fed. Rep. of Germany

[21] Appl. No.: 839,688

[22] Filed: Mar. 14, 1986

Related U.S. Application Data

[63] Continuation-in-part of Ser. No. 730,475, May 3, 1985, abandoned.

[30] Foreign Application Priority Data

Apr. 6, 1983 [DE] Fed. Rep. of Germany ..... 3312397

[51] Int. Cl.[4] ..... B21D 7/022

[52] U.S. Cl. ..... 72/306; 72/217; 72/384; 72/403; 72/702

[58] Field of Search ..... 72/305, 306, 321, 323, 72/403, 384, 308, 311, 215–219, 702

[56] References Cited

U.S. PATENT DOCUMENTS

| | | | |
|---|---|---|---|
| 1,546,147 | 7/1925 | Skinner | 72/217 |
| 1,769,570 | 7/1930 | Groehn et al. | 72/217 |
| 3,568,300 | 3/1971 | Zidell | 72/319 |
| 4,012,933 | 3/1977 | Porter | 72/217 |
| 4,479,373 | 10/1984 | Montorfano et al. | 72/306 |

FOREIGN PATENT DOCUMENTS

| | | | |
|---|---|---|---|
| 209424 | 12/1983 | Japan | 72/217 |

*Primary Examiner*—Daniel C. Crane
*Attorney, Agent, or Firm*—Jordan B. Bierman

[57] ABSTRACT

In order to form materials (18) in a cold state automatically and reproduceably a bending machine (10) is proposed, comprising at least two bending carriages (14, 16), which interact with the material so that one of the bending carriages (14 or 16) constantly holds the material (18) immoveable when the other bending carriage (16 or 14) is bending the material (12) or is being moved along it.

8 Claims, 14 Drawing Figures

PROCESS FOR THE BENDING OF ROD-LIKE MATERIALS

This application is a continuation-in-part of Ser. No. 730,475, filed May 3, 1985, now abandoned.

BACKGROUND OF THE INVENTION

The invention relates to a process as well as to a device for the bending of rod-like materials, e.g. reinforced steels, comprising two bending carriages with drives, whereby the bending carriage comprises a bending mandril and a bending crank arranged in a revolvable manner around said mandril.

In U.S. Pat. No. 3,803,893 a device is described for the bending of rod-like materials comprising two bending carriages each with a bending mandril with corresponding bending crank. During bending a section of material is held fast by a bending carriage. The other bending carriage is used for bending. So that the material is not moved during bending, i.e. so that the bending carriage not bending holds the material so that it cannot slip, it is necessary for this section of the material to be alredy bent. As a result of this, turning the material relative to its longtiduinal axis by 180° for example is not possible after bending once in a direction. Neither can a rod-like material be bent only in one end area, in as much as the bending carriage at the other end ought to hold the overall exclusively. On the contrary, further holding devices must be provided.

SUMMARY OF THE INVENTION

The object of the submitted invention is to develop a process and device of the nature initially described, in that a bending process is possible with which bending configurations of a high accuracy are possible, whereby besides the bending carriages further devices holding the material are not necessary.

The object is achieved on the one hand in that rod-like material is held and bent by the bending carriages in such a way that a section of the material is held fast alternately by one of the bending carriages, while the bending carriage not holding the material bends or is moved along said material, whereby the material, at least in the area of the section where it is being held and which is not bent, is bent at an angle $\alpha$, which leads exclusively to an elastic deformation. In other words, according to the invention it is suggested that the bending carriage can also hold rod-like material if said material is not yet deformed. According to the state of the art this is not possible.

According to the invention the elastic deformability is taken into account. If consequently the material is bent to an angle $\alpha$ not yet resulting in a permanent deformation, it is ensured that the material is held securely by the bending carriage, so that the other bending carriage can be moved to the required extent and carry out the plastic deformation if necessary. The angle $\alpha$, which can also be termed a back-spring angle, is especially added to each planned angle, i.e. to bending angles, in order to ensure that the plastically deformed section also has the desired geometry when the bending carriage is no longer in operation. Consequently the angle $\alpha$ should be the maximum angle at which the material can be bent without resulting in a plastic deformation.

A further embodiment of the invention is distinguished by the fact that, during the bending of an enclosed bending form, the bent material present in the area of the bending mandril is bent over the bending mandril over material to be bent, e.g. over a metal ramp. Further bending process is not prevented by this.

The bending crank itself comprises an excentrically positioned bending roller which can be arranged in a fixed manner. At the same time the distance between the axle of the bending roller and the turning axle of the bending crank can be variable. Furthermore the bending mandril can comprise a main mandril provided with exchangeablecaps, so as to enable the bending carriage to be easily adjusted to rod-like materials of varying diameter.

BRIEF DESCRIPTION OF PREFERRED EMBODIMENTS

Further details, advantages and characteristics can be drawn from the claims, the following description and drawing, from which—without further explanations being necessary—main characteristics of the teaching according to the invention can be deduced, also in the absence of detailed description.

FIG. 1: A top view of the device according to the invention

FIG. 2: A hydraulic circuit diagram

FIG. 3: Use of the device according to FIG. 1 in a processing line

FIG. 4: A detailed representation of a bending crank motor

FIG. 5: A section of one of the first models of a bending carriage

FIGS. 6–8: Diagram representation of bending processes

FIG. 9: A metal ramp arranged in the area of a bending mandril

FIGS. 10 and 11: Bend configurations of round steel manufactured with the device according to the invention FIG. 12: A section of a model of a bending carriage FIGS. 13 and 14: Further diagram representations of bending processes.

DETAILED DESCRIPTION OF THE PREFERRED EMBODIMENTS

Figure 1:
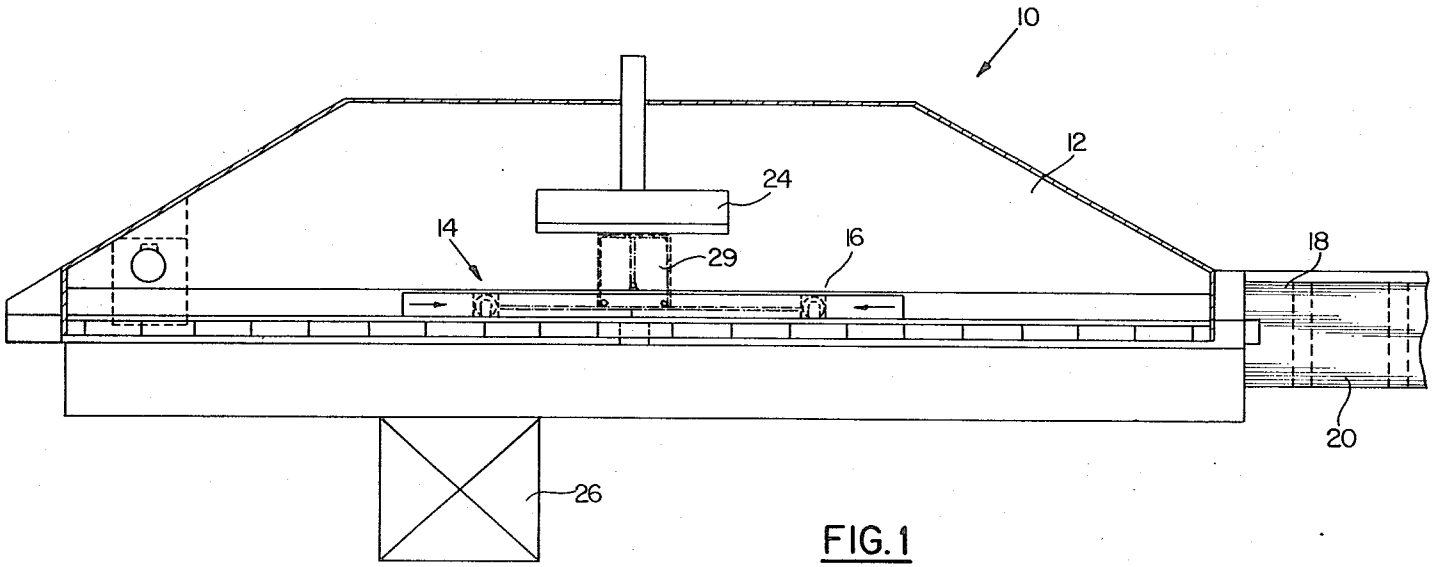
Figure 3:
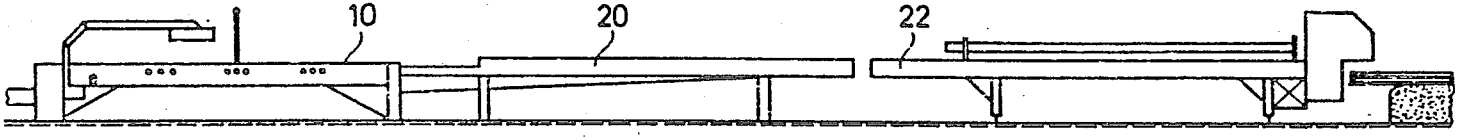

In FIG. 1 a bending machine 10 is shown in diagram-form in top view, comprising a horizontal working table 12. In the example model two bending carriages 14 and 16 are placed, in moveable positions, in longitudinal direction to the working table 12, by means of which preferably rod-like prepared steel materials 18 to be fed into the bending machine—as described in more details as follows—should be bent. These rods 18 enter the machine from a material magazine 20, whereby several rods 18 can be bent at the same time by means of the bending carriages 14 and 16. The material magazine 20 can thereby constitute part of a processing line represented in diagram-form in FIG. 3, positioned between the bending machine 10 and rod-cutting machine 22. The rod-cutting machine can thereby adhere to a principal as described in the German Patent Application No. 32 06 673 by the same Applicant. The material magazine 20, which can be a bending trolley rolling conveyor, thereby serves at the same time as buffer. By use of machine 10 in a processing line the advantage of a high through-put volume is achieved, without further explanations hereto being necessary. The bending machine 40 can be programmed via a keyboard 24, in order to thus form the materials 18 in a cold state to the required extent. It should further be mentioned that the working table 12 has a slit running vertically or almost vertically to the said bending machine 10 for the take-up of several round materials to be stacked on top of each other, the slit being bounded at the sides by the bending carriages 14 and 16. Furthermore a container 26 is indicated beside machine 10, into which the bent materials 29 can be thrown manually. Naturally there is also the possibility of integrating an automatic ejection device in machine 10.

Figure 4:
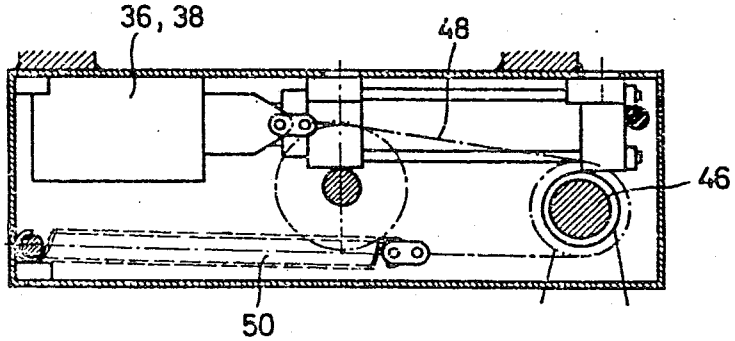
Figure 5:
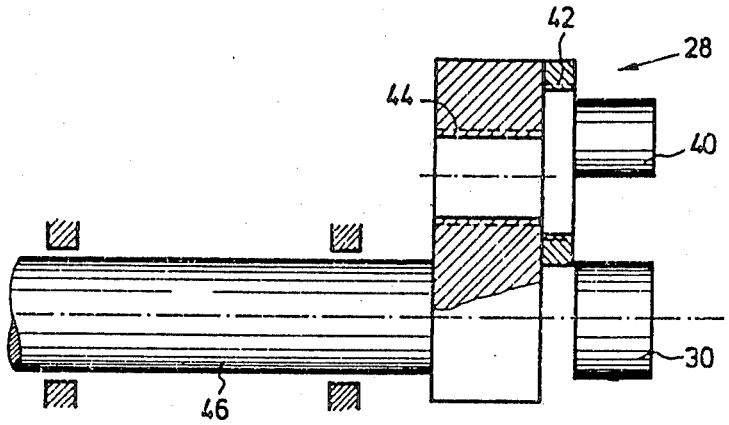

Each bending carriage 14 or 16 consists of one bending crank 28, a bending mandril 30 as well as a motor 32, 34, 36 or 38. Thereby the bending crank 28 moves at a distance around the bending mandril 30. The materials to be formed lie between bending crank 28 and bending mandril 30. As indicated in FIG. 5 the bending crank comprises an eccentrically placed cylinder mandril 40, if necessary revolvable around its axis, which is held constant in the required position (infinitely variable axial spacing bending cylinder 40, bending mandril 30) via two opposed threads 42 and 44, so that irrespective of the turning direction of the bending crank 28 the bending mandril 40 cannot be loosened. The bending crank is also taken up eccentrically by a spindle 46, connected to one of the hydro cylinders 36 or 38. Thereby the linear movement of hydro cylinders 36 or 38 is converted into the required rotating movement via a chain 48. The chain 48, co-working with the spindle 46, is thereby joined at one end with hydro cylinder 36 or 38 and at the other end via a spring pre-stressed element 50. The exact construction and effect is easily apparent from FIG. 4.

Figure 2:
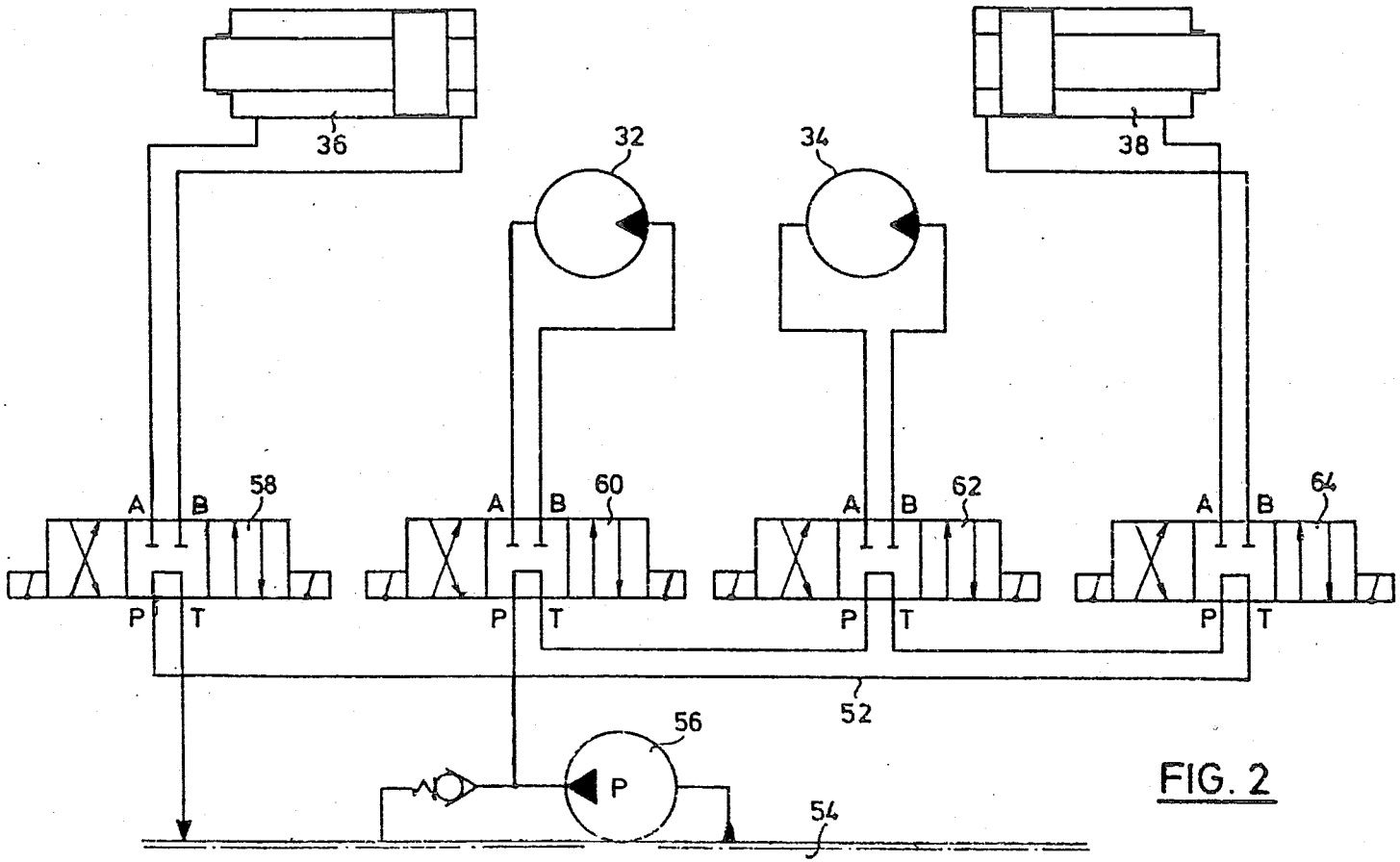

Should the rotating movement of bending crank 28 be produced preferably by means of hydro cylinders 36 and 38, the translatory movement of bending carriage 14 or 16 occurs itself preferably via hydro motors 32 and 34 with rotating initial movement. According to the invention the hydro cylinders 36 and 38 as well as the hydro motors 32 and 34 are to be found in one hydraulic circuit 52, as shown clearly in FIG. 2. This has the advantage that all power means can be driven by one single aggregate, thus rendering extensive checking and control devices unnecessary. However even when only one single hydraulic circuit is necessary it is nevertheless ensured that all power means 32 to 38 can operate completely independently of each other. In the invention the single power means 32, 34, 36, 38 are arranged in the circuit 52 as follows. The first hydro motor 32 is behind pump 56 carrying working fluid 54. The second hydro motor 34 is arranged in a circuit manner behind the first hydro motor 32. The hydro cylinders 38 and 36 then follow to conclude the circuit. In the example model according to FIG. 2 the connection leads between the circuit 52 and the power elements 32 to 38, produced via magnet valves 58, 60, 62 or 64. If all valves 38 to 64 are closed the working fluid 54 flows freely through the circuit 52. If for example the valve 60 is so activated that a connection to the hydro motor 32 results—a PB/AT or PA/BT connection is consequently produced—due to valves 62, 64 and 58 otherwise not activated the working fluid can therefore continue to flow back directly. If however valve 62 is also activated, i.e. if both bending carriages 14 and 16 are to be propelled concurrently, the hydro motor 34 is turned by the run-back fluid of motor 34, without the action's independance being neutralised. Accordingly the run-back fluid of motor 34 can turn the hydro cylinders 38/36. The same can of course then occur when only one of the hydro motors 32 or 34 or none of them is turned by the working fluid 54. From the latter description it is apparent that the power means 32 to 38 are arranged in one single hydraulic circuit 52 and are completely independent of each other, can however also be activated together.

Figure 6:
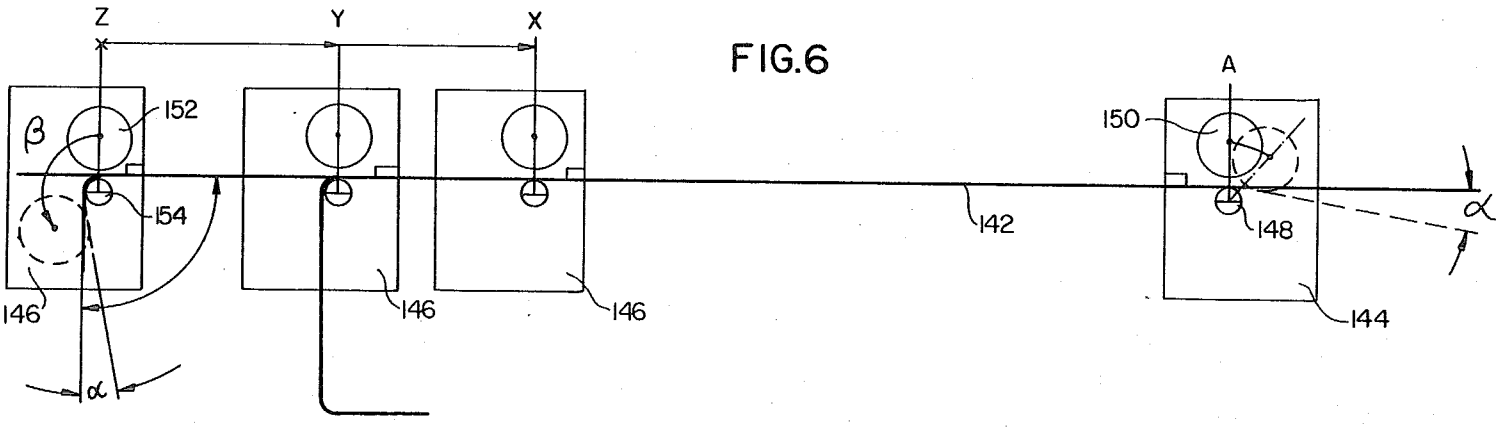
Figure 7:
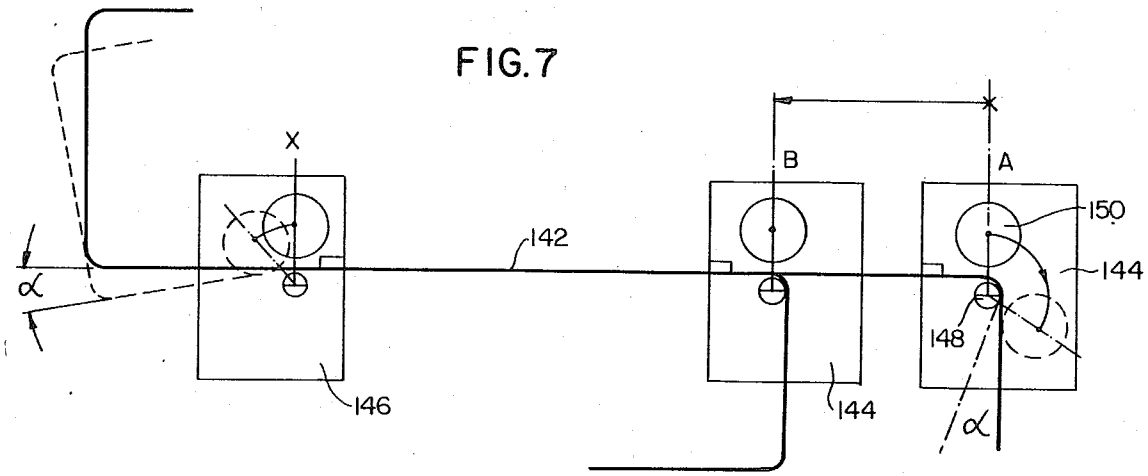
Figure 8:
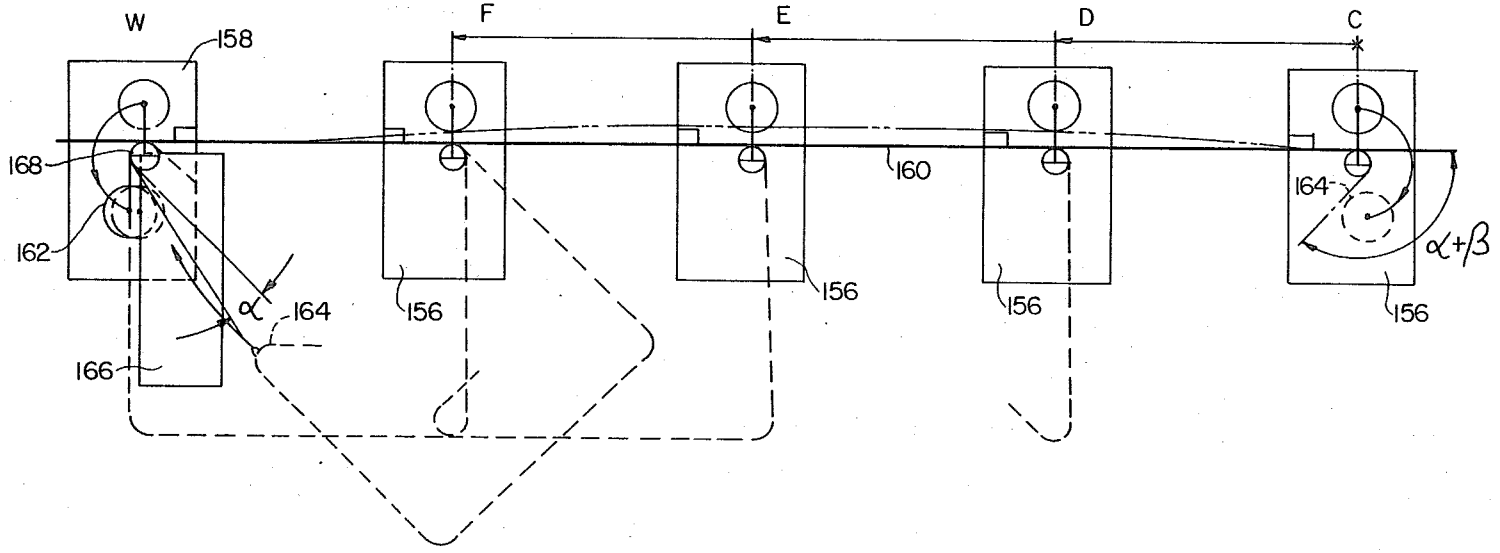

A main characteristic of the invention is that during the bending process at least a section of the material 18, is held constant between bending mandril and bending crank in such a way that the material cannot slip while the other bending carriage is moving along it. FIGS. 6–8 should describe such a bending process in more detail. The single parts of the bending carrigae represented are not described in more detail here. Rather the bending carriage can be constructed as is described in connection with the FIGS. 4, 5 and 12–14.

In FIGS. 6 and 7 a rod-like material such as reinforced steel 142 should be bent to both sides relative to its longitudinal axis. Two bending carriages 144 and 146 are used for this, alternately holding the material 142 exactly in position and bending to the required extent. First of all the bending carriage 144 holds the material 142 tightly in the position A. As the mandril is not yet bent it is first of all bent at an angle $\alpha$. The angle $\alpha$ depends on the rod material. The angle $\alpha$ is so large that the material is only deformed elastically and not plastically. However as the material is bent at the angle $\alpha$, there results a clamping between the bending mandril 148 and the bending crank 150, thus in the dotted representation in position A. The bending carriage 146, which can also be termed a bending tool, is in position Z. If the end of the material 142 is now to be bent at an angle $\beta$, the bending crank 152 is turned around the bending mandril 154 of the bending tool 146 at an angle $\beta+\alpha$, whereby the angle $\alpha$ corresponds exactly to the angle at which the material springs back when the bending crank 152 is no longer influencing the material 142 in the end area. If the first bending process (position Z) previously has been described in such a way that during bending the bending carriage 144 has bent the material 142 at an angle $\alpha$, then of course the elastic deformation can be corrected after commencement of the bending process by the bending carriage 146, i.e. the bending crank 150 returns to the basic position (solid line). However it is important that at least during movement of one of the bending carriages the other on clamps the material tightly.

In order to bend the left end of the material 142 again in a position Y to the desired extent, the material 142 is again clamped tightly by the bending tool 144 (thus bending at the angle $\alpha$). As soon as position Y is taken up the bending tool 144 can open up again to release the clamp. Then the bending tool 146 in position Y bends the material 142 again. The bending tool 144 should thereby only completely release the clamp when the bending tool 146 has already begun the bending process in order to be certain that the material 142 cannot be moved along its longitudinal axis during bending. In order to begin a further bending process, namely such a one that the end grasped by the bending carriage 146 is bent in the opposite direction to the end lying opposite, the bending carriage 146 is moved into position X. The bending carriage 144 clamps the material 142 again. Then the rod 142 is turned by 180°. During this the bending carriages 146 and 144 have to release the material. Now the bending carriage 144 has to bend the end allocated. Consequently the bending tool 146 pinches by elastic deformation of the material 142 (bending at an angle $\alpha$), in order to then turn the bending crank 150 around the bending mandril 148 to the required extent. In doing so the turning angle equals the required angle $\alpha$, which corresponds to the angle at which only an elastic deformation of the material results, but not a plastic one. As soon as the bending process is concluded in position A the bending carriage 146 clamps the material 142 in position X. Then the bending carriage 144 is moved into position B. As soon as the bending process begins in position B, the bending carriage 146 can release the clamp. Consequently FIGS. 6 and 7 clarify that, without a deformation of the material being necessary, each bending carriage 144 or 146 can clamp the rod material 142 tightly by using the elastic property of the material. Clamping takes place thereby at least during the movement of one one of the bending carriages 144 or 146 along the material 142.

FIG. 8 clarifies a further bending process which takes place via bending carriages or bending tools 156 and 158. In this case at least the other bending carriage 158 or 156 is in a clamp position during the moving of bending carriage 156 or 158. Thereby the material 160 which is to be deformed is bent between the bending carriages 156 and 158 (dotted line). It thus becomes apparent that, in order to exclude distortion of the length, clamping should only take place during the moving (of a carriage), whereas during bending the clamp position is lifted so that the carriage executing the bending process can bend the material at the point corresponding to the actual length. Otherwise it could be necessary to have braces placed over the length of the material 160, which however would prevent free movement of the bending carriages 156 and 158. In FIG. 8 the bending process takes place as follows: First of all the rod material 160 is plastically deformed in position C of the bending carriage 156 and position W of the bending carriage 158. Then the bending carriage 158 clamps the rod material 160 tightly so that the bending carriage 156 can move to position D. During moving the material 160 is bent. However during the bending process in position D the clamping of the bending carriage 158 is released so that the material 160 takes up the position indicated by the straight line. After bending in position D the material 160 is clamped again by the bending carriage 158. Then the bending carriage 156 is moved into position E. A bending process also takes place in this position. Finally the carriage 156 is moved into position F with the material 160 clamped tightly by the bending carriage 158 to enable the last bending process to take place. All bending processes take place at an actual angle=scheduled angle (angle at which the final material should be bent) minus angle $\alpha$ (the angle at which the material is not yet plastically deformable). (With a bending machine the angle can be programmed, namely dependantly on the material to be bent and its dimensions).

Figure 9:
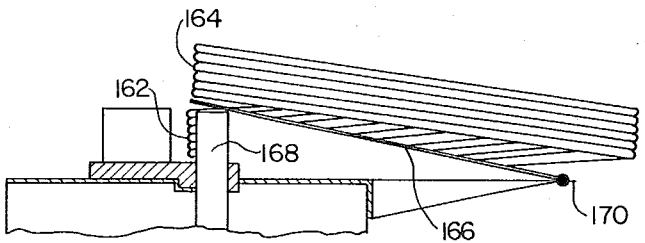

FIG. 9 should illustrate a further characteristic of the invention which should be stressed. During the bending of several rods over each other there arises the problem of bending in during the last bending, thus during bending in position F. If the material should be bent to the required extent—in the present case to a square—the end 164 would be prevented by the end 162 which is clamped and resp. bent by the bending carriage 158. In order to exclude this the bending carriage 158 is provided with a so-called metal ramp 166. This metal ramp 166 leads the end 164 over the bending mandril 168 of the bending carriage 158. After the bending process has been concluded, i.e. the ends 164 and 162 are resting over each other and above the bending mandril 168, removal of the bent material is facilitated in that the metal ramp 166 can be swivelled round a revolving point 170. Through this the material can be easily removed from the bending carriage 158.

Figure 10:
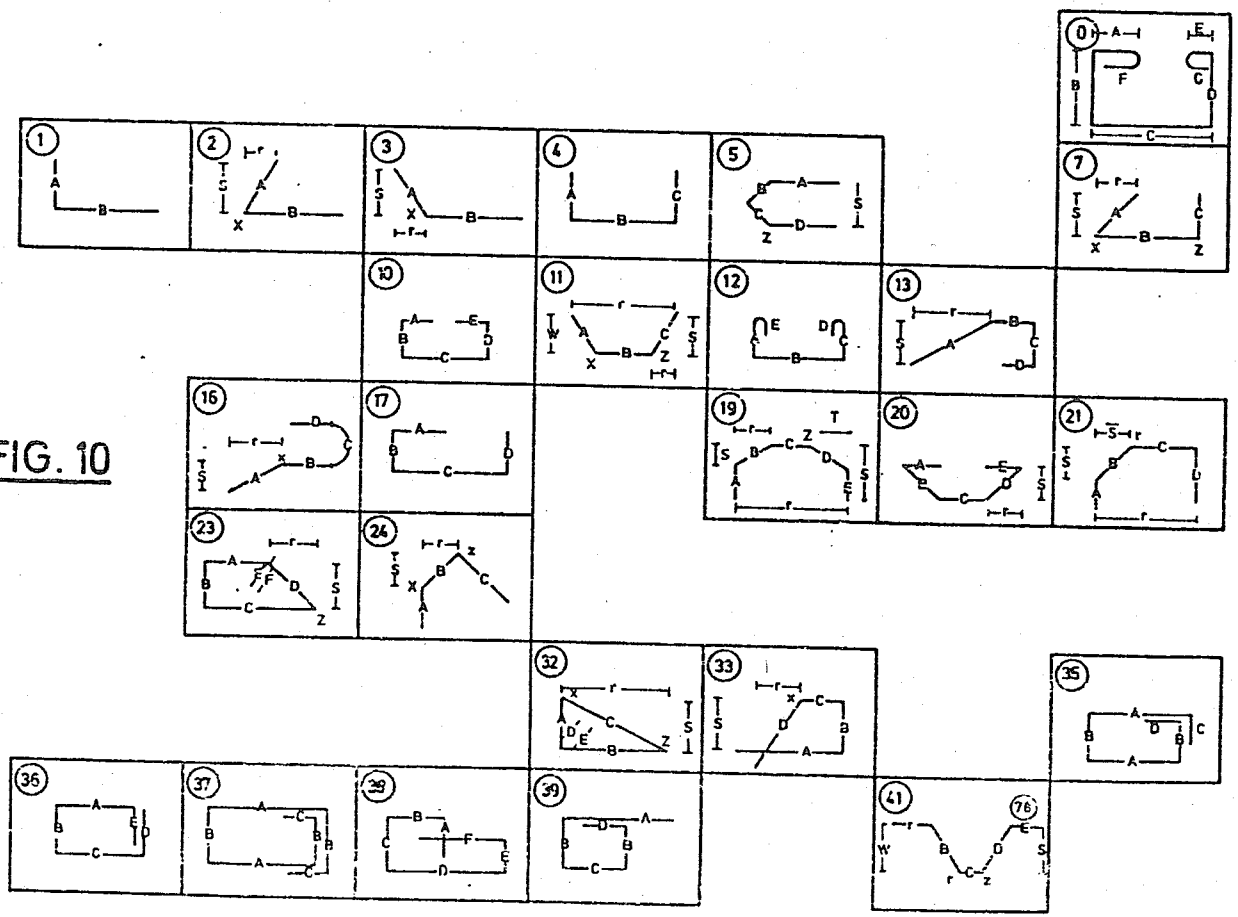
Figure 11:
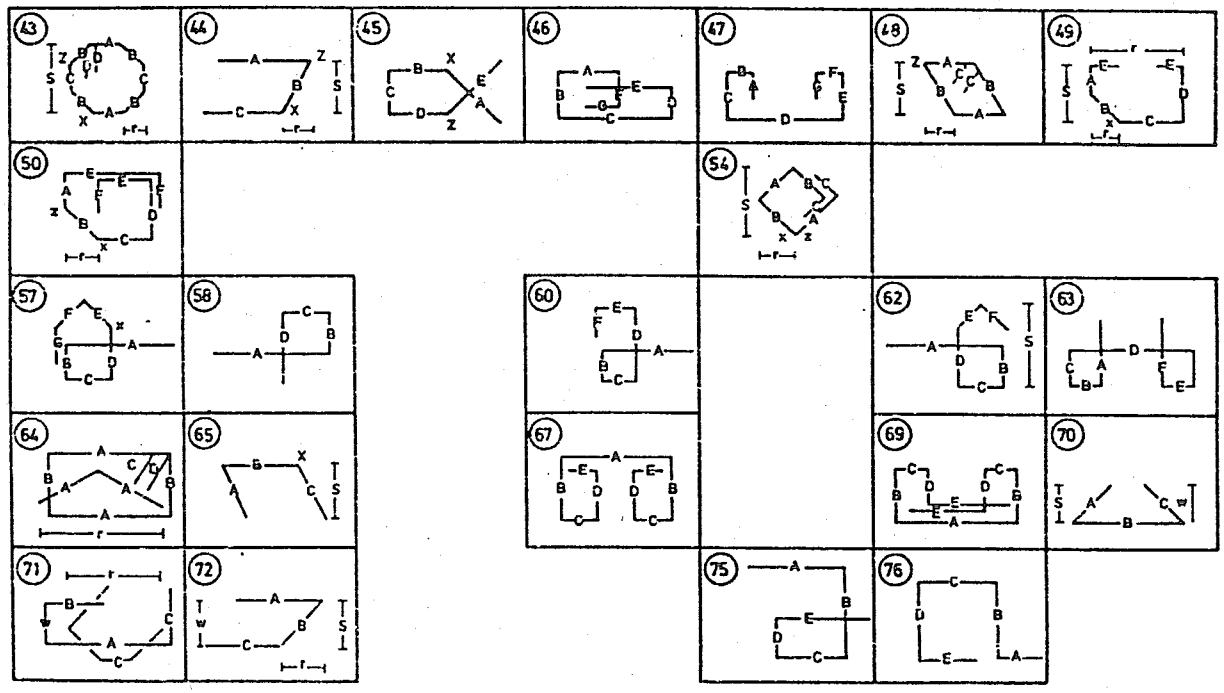
Figure 12:
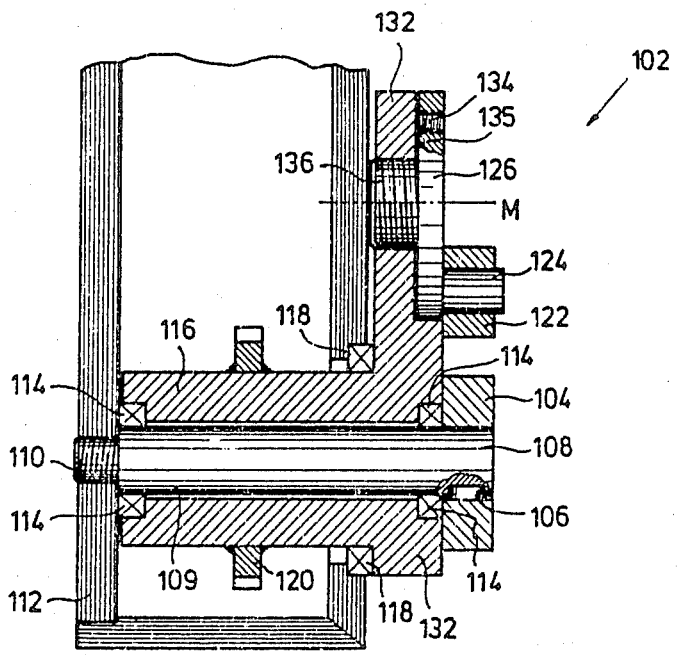

FIGS. 10 and 12 show in exemplary fashion varying bending forms of round steel which can be achieved by using the teaching according to the invention. A large diversity is obvious, whereby it should be noted that the degree of accuracy of the end product is very high, so that the percentage of the cold deformed material which cannot be used is very small.

FIG. 12 shows a particularly interesting own-invention form of a bending crank 102 which is revolvable around a bending mandril 108. In the embodiment example the bending mandril 108 is the end of a fixed shaft 109, which in turn is arranged in a non-revolvable manner in a section of the bending carriage casing 112 via a thread 110. Exchangeable bending stencils 104 can be set on the bending mandril 108 which are fastened on the bending mandril 108 in an non-revolvable manner for example via a pan spring 106 or a similarly functioning element.

The bending crank 102 is now turned around the shaft 109, whereby the bending crank 102 is supported over a hollow cylinder section 116 via bearing 114 on the shaft 108 and via bearings 118 opposite the casing 112. Furthermore the hollow cylinder section 116 has a pinion drive 120 via which the turning of the bending crank 102 as described above takes place. The bending crank 102 now shows a roller mandril 122 excentrically to the turning axle which is joined to a cam disc 126 via a pin 124. The roller mandril 122 can be thereby positioned in a revolvable manner around the pin 124. Contrary to this the bending mandril 104 is arranged in a non-rotating manner. The same applies to the caps or bending stencils 104 and 128, 130 according to FIGS. 13 and 14 arranged—as mentioned on—the bending mandril 108. The cam disc is joined to a limb 132 protruding from the hollow cylinder 116 via a cam pin 136 whose thread is chosen so that during turning of the bending crank 102 for the bending of material to be laid between the roller mandril 122 and bending mandril 108 or resp. bending stencil 104, the cam disc is tightend without the position of the bending roller being altered. To this effect spacing elements protrude from the side of the cam disc facing the bending crank 102 with which the cam disc is positioned on the section 132 of the bending crank 102 facing away free from backlash.

The position of the cam disc 126 and with it that of the roller mandril 122 relative to the turning angle can now be set by means of block screws 134 used as spacing elements in order to be able to solve the aims shown as follows. It is namely required that in the bending of concrete steel materials 18 bending radii can be produced dependant on the rod diameter. According to the valid building regulations five different relations have to be adhered to. These are: bending diameter=4*d* or 5*d* or 7*d* or 15*d* or 20*d* with d=rod diameter. In a range of d-diameters between 24 and 560 mm this requires 60 different bending stencils and the necessary bending pin settings, in as far as the familiar bending devices are used. IN the case of the familiar bending devices either the bending crank with fixed bending mandril has to be exchanged when the bending stencil is altered, or the bending pin has to be changed around on the bending crank. This also requires varying diameter of roller mandrils as the change in the bending pin is not possible in randomly small steps, whereas the diameter of the steels to be bent vary by millimetres. (Corresponding familiar bending machines are for example familiar under the name MUBEA BO 55, 32, 40L).

Figure 13:
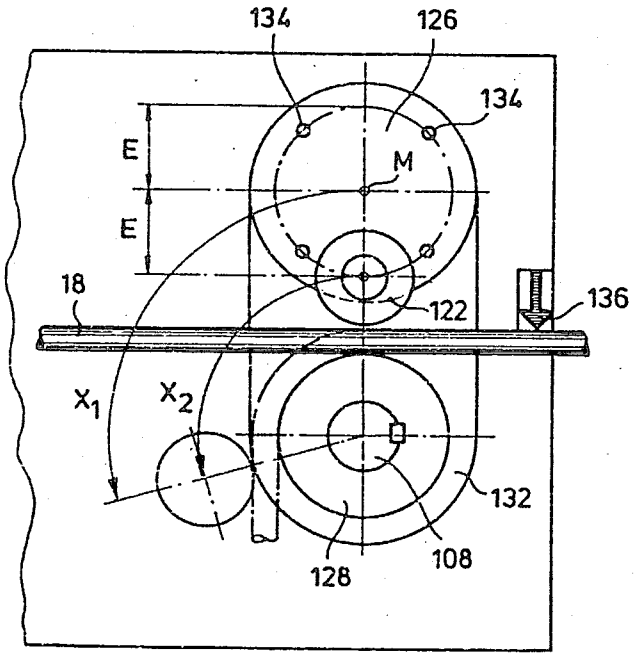

According to the invention and according to the proposals in FIGS. 12 and 5 a simplification is achieved to the effect that only the bending stencils 104, 128, 130 have to be exchanged, whereas the roller mandril, after loosening of the block screws 134 around the centre point M of the cam disc 126, is moved into the necessary bending position, which can differ by 2° E with E the maximum distance from the centre point (see FIG. 13). When the necessary position of the roller mandril 124 is set the block screws are tightened, thus the cam disc 126 pushes against the surface 135. As the screw pitch of the cam pin thread runs contrary to the revolving direction of the bending crank 102, a clamping of the cam disc 126 is ensured in the case of frictional connection of the pin 136 by means of the roller mandril 126 with the material to be laid between the latter and bending stencil 128 ( for example if the bending crank is turned anti-clockwise the pitch of the cam mandril is right-handed.)

The bending crank 102 with the bending mandril 122 is now turned on a circle $X_1$ around the shaft 108 as centre point, whereby the radius of the roller mandril 120 can be larger or smaller than $X_1$ dependant on its position to the centre point M. In the embodiment example according to FIG. 13 the radius $X_2$ is smaller than $X_1$, whereas in the embodiment example according to FIG. 14 the radius $X_3$ is larger than $X_1$.

Figure 14:
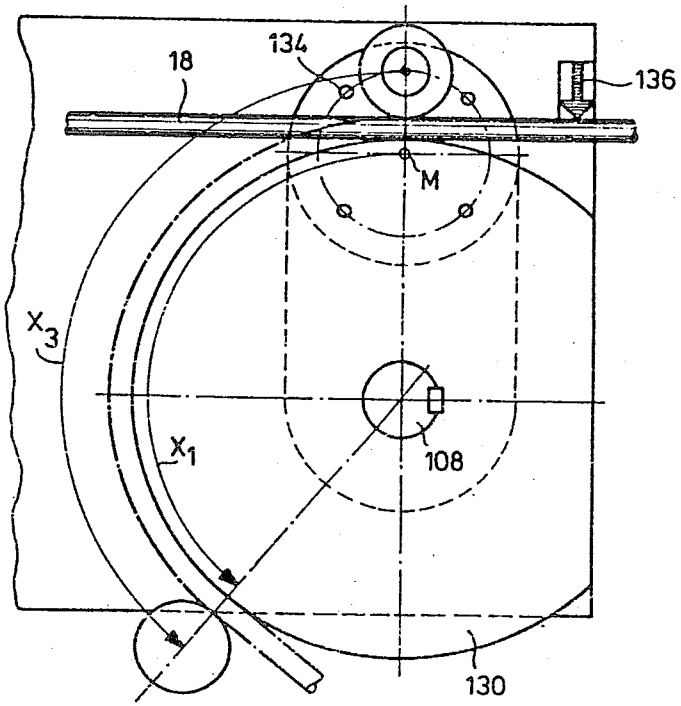

From the embodiments in FIGS. 13 and 14 it becomes apparent that the bending stencils 128 or 130 resp. can have varying diameters dependant on the material to be bent or the bending radius to be achieved. Finally FIGS. 13 and 14 also illustrate a heel 136 in order, during bending, to hold the material 18—relative to the section not to be deformed—in a horizontal position in the embodiment example.

I claim:

1. A method for the bending of rod-like materials, such as reinforced steels, comprising providing first and second bending carriages each with one bending mandril and a bending crank arranged rotatively around said mandril, movably arranging said carriages each along the material, immovably holding the material by the bending mandril and bending crank of the first carriage by bending said material at an angle $\alpha$ resulting in only an elastic deformation, moving said second bending carriage along the material to a desired position on the material while holding said material by said bending mandril and bending crank of said first bending carriage, releasing said material held by said first bending carriage and plastically forming the material to desired shapes by the bending mandril of the second bending carriage, immovably holding said material by the bending mandril and bending crank of said second bending carriage by bending said material at an angle $\alpha$ resulting in only an elastic deformation, and moving said first bending carriage along the material to a desired position on the material while holding said material by said bending mandrel and bending crank of said second bending carriage, releasing said material held by said bending mandril and bending crank of said second bending carriage and plastically forming the material in desired shapes by the bending mandril of the first bending carriage.

2. Method according to claim 1, whereby in every plastic bending process the angle $\alpha$ is added to the required bending angle $\beta$ determining the final form of the material.

3. Method according to claim 1, whereby the angle $\alpha$ is the maximum angle at which the material is bendable without a plastic deformation resulting.

4. Method according to claim 1 characterised in that the drive elements for the bending carriages are arranged in one single hydraulic circuit.

5. Method according to claim 1 whereby bending at an angle $\alpha$ is cancelled during bending of the material with the other bending carriage.

6. Method according to claim 2 whereby the bending carriage holding the material is turned back to the bending angle $\beta$ by the angle $\alpha$ during movement of the other bending carriage along the material.

7. Method according to claim 1 whereby bent material sections are lifted over material sections to be bent in the area of a bending carriage.

8. The method according to claim 1, wherein the rod-like material, in order to obtain sections bent in opposite direction after the bending of one section, is turned 180° around its longitudinal axis and is subsequently bent anew.

* * * * *